US006041770A

United States Patent [19]

Erickson

[11] Patent Number: 6,041,770

[45] Date of Patent: Mar. 28, 2000

[54] BI-METALLIC CONTROL DEVICE

[76] Inventor: Paul E. Erickson, 2975 Allenby Road, Duncan British Columbia, Canada, V9L 4T8

[21] Appl. No.: 09/073,056

[22] Filed: May 5, 1998

[51] Int. Cl.[7] ..... F24C 1/14; F23L 3/00; F23N 1/00

[52] U.S. Cl. ..... 126/77; 112/285 R; 112/289; 112/290; 112/193; 236/99 F; 236/101 D

[58] Field of Search ..... 126/77, 93, 112, 126/193, 285 R, 289, 290; 236/96, 99 F, 101 D; 432/36, 48

[56] References Cited

U.S. PATENT DOCUMENTS

| | | | |
|---|---|---|---|
| 1,884,987 | 10/1932 | Wessels | 236/96 |
| 1,971,431 | 8/1934 | Sigmon | 236/96 |
| 2,470,533 | 5/1949 | Thomas | 236/96 |
| 3,099,436 | 7/1963 | Siddle et al. | 236/96 |
| 3,168,088 | 2/1965 | Martin et al. | 126/77 |
| 4,117,824 | 10/1978 | McIntire et al. | 126/15 R |
| 4,136,662 | 1/1979 | Willson | 126/61 |
| 4,141,336 | 2/1979 | Fitch | 126/512 |
| 4,194,487 | 3/1980 | Cadwallader et al. | 126/77 |
| 4,214,569 | 7/1980 | Heine | 126/77 |
| 4,265,213 | 5/1981 | Gorsuch et al. | 126/66 |
| 4,350,141 | 9/1982 | Miller | 126/77 |
| 4,409,956 | 10/1983 | Barnett | 126/290 |
| 4,530,346 | 7/1985 | Roy | 126/77 |
| 4,677,965 | 7/1987 | Duerichen | 126/76 |
| 5,284,127 | 2/1994 | Driesmans | 126/77 |

*Primary Examiner*—Ira S. Lazarus
*Assistant Examiner*—David Lee
*Attorney, Agent, or Firm*—Townsend and Townsend and Crew, LLP

[57] ABSTRACT

A bi-metal control flap for a wood stove is biased to close by gravity and is controlled to open an air inlet when the temperature rises which is opposite to the traditional bi-metal control systems which close when the temperature rises. The valve is a free pivoted L-shaped flap with a first portion and a second portion extending from a pivot position and supported by a casing. The first portion is positioned over an air supply inlet and retained over the inlet by gravity. A crank arm supported by the casing rotates to push against the second portion of the flap to open the flap a predetermined amount, and a bi-metal strip coil having an outer end attached to the casing and a floating inner end attached to the crank arm such that a change in temperature causes the crank to rotate to open the flap or allow the flap to close by gravity.

17 Claims, 2 Drawing Sheets

BI-METALLIC CONTROL DEVICE

FIELD OF THE INVENTION

The present invention relates to wood stoves and more specifically to a method of controlling air flow through an air inlet into the combustion chamber of a wood stove by means of a bi-metal control flap.

BACKGROUND OF THE INVENTION

Large wood stoves which are generally called "large box" wood stoves have acquired a reputation of not performing well at either high or low burn rates. One of the reasons for this is that a large stove is required to perform in a much bigger window of burn rate than the common small or mid-size units that operate in a smaller range. Existing wood stoves provide a combustion air system which is generally two or three separate air supplies, some of which may have set openings. Thus, the chosen ratio for set openings may be ideal for a particular burn, for example, a high burn, but it provides an air mixture that is only barely adequate for a low burn. Thus, the narrow window of optimum performance for a large wood stove often yields a stove that has difficulty passing emission standards and in some cases is unresponsive or uncontrollable for in-house use.

It is considered that people buy large wood stoves for two main reasons. One is to have high output at maximum burns and the other is fire holding properties at low burns with good efficiencies at both high and low burns.

With combustion air supply systems having set openings, it has been found that a stove with a minimum set opening large enough to pass the United States EPA regulations for low emissions at minimum burn, provides too much air for normal use. Conversely, if the stove is able to produce a satisfactory extended low burn in the home, then the EPA test results would be poor if met at all.

To overcome this problem, some type of internal self-regulation to vary one or more of the air supplies at different burn rates has been considered. It is generally felt that incorporating electronics, i.e., thermocouples, solenoids, power supplies, logic boards, etc., would be achievable but at high cost and consumers generally would not accept electronics on a wood stove. Thus, simple bi-metal elements have been used on wood stoves for many years. These are cheap to buy, do not require any external power supply and are accepted by the consumer. Examples of wood stoves with bi-metallic thermostats or strips to pivot inlet dampers are disclosed in U.S. Pat. No. 4,136,662 to Willson, U.S. Pat. No. 4,214,569 to Heine, U.S. Pat. No. 4,117,824 to McIntire et al, U.S. Pat. No. 4,409,956 to Barnett, U.S. Pat. No. 4,677,965 to Duerichen and U.S. Pat. No. 4,265,213 to Gorsuch et al.

As will be seen for most of these wood stoves, bi-metal systems control the overall air supply, not a selected portion. Furthermore, traditionally all bi-metals are configured to close air inlets when the temperature rises. Thus, as the temperature rises, the fuel consumption increases, the bi-metal senses the temperature rise and begins to close the air inlet. With less air entering, the overall stove temperature starts to decrease, the bi-metal senses the temperature drop and gradually opens the air inlet. Most bi-metals are connected directly to a flap or gate which continuously fluctuates or oscillates, thus the stove does not remain at a constant temperature.

It is an aim of the present invention to provide a wood stove that has a wide range of burn rates that comply with the United States Environmental Protection Agency emission regulations and also offer "user friendly" characteristics to a consumer. It is a further aim of the present invention to provide a wood stove that does not have the traditional fluctuating or oscillating control function which causes the stove temperature to continuously rise and fall.

SUMMARY OF THE INVENTION

The present invention discloses a bi-metal control system with a gravity flap over an air inlet. The control system works opposite to the traditional bi-metal control systems because when the temperature rises the bi-metal opens the flap against gravity, thus additional air initially increases stove temperature which causes the bi-metal control to continue opening the flap.

The bi-metal control comprises a crank arm rotated by a bi-metal coil. The crank arm pushes against the gravity flap to open it and hold it open a predetermined amount. If the temperature continues to rise, the crank arm continues to rotate but does not open the flap any further as a stop is provided for the flap to restrict flap movement.

The crank arm is not connected to the gravity flap, thus when the stove temperature drops, the bi-metal coil rotates the crank arm until it is free of the flap and the gravity flap closes. Further rotation of the crank arm as the stove cools does not re-open the flap. The temperature must increase considerably before the crank arm re-opens the gravity flap.

The bi-metal coil is placed in a location where the temperature, while reflecting the overall current burn rate, does not fluctuate erratically as would be found on the stove top or in the flue pipe. A location below the stove is preferred. In one embodiment three air systems are provided for a wood stove, namely an air wash system, a preheated secondary system and a primary air system. It has been found that the primary air inlet is appropriate for the gravity flap.

The present invention provides a method of controlling air flow through an air inlet to a combustion chamber of a wood stove comprising the steps of opening a gravity closing flap over the inlet with a bi-metal strip coil when the temperature rises and permitting the flap to close by gravity when the temperature drops.

The present invention also provides a method of controlling air flow through an air inlet to a combustion chamber of a wood burning stove, comprising the steps of sensing temperature rise in the wood stove with a bi-metal strip coil having a fixed outer end and a crank arm connected to a floating inner end, rotating the crank arm as the temperature rises to push against a free pivoted flap retained by gravity over the air inlet to open the air inlet and permit air to flow therethrough, sensing temperature drop in the wood stove with the bi-metal coil, rotating the crank arm in the opposite direction from the temperature rising, as the temperature drops to permit the flap to close by gravity over the air inlet, and permitting the crank arm to continue rotating as the temperature drops without effecting the closed flap.

In yet a further embodiment there is provided a bi-metal closure valve for an air supply inlet for a wood stove, comprising a free pivoted L-shaped flap, the flap having a first portion and a second portion extending from a pivot position and supported by a casing, the first portion positioned over the air supply inlet and retained over the inlet by gravity, a crank arm supported by the casing to rotate and push against the second portion of the flap to open the flap a predetermined amount, and a bi-metal strip coil having an outer end attached to the casing and an inner coil attached to the crank arm such that a change in temperature causes the crank to rotate to open the flap or allow the flap to close by gravity.

BRIEF DESCRIPTION OF THE DRAWINGS

In drawings which illustrate embodiments of the present invention.

DESCRIPTION OF THE PREFERRED EMBODIMENT

Figure 1:
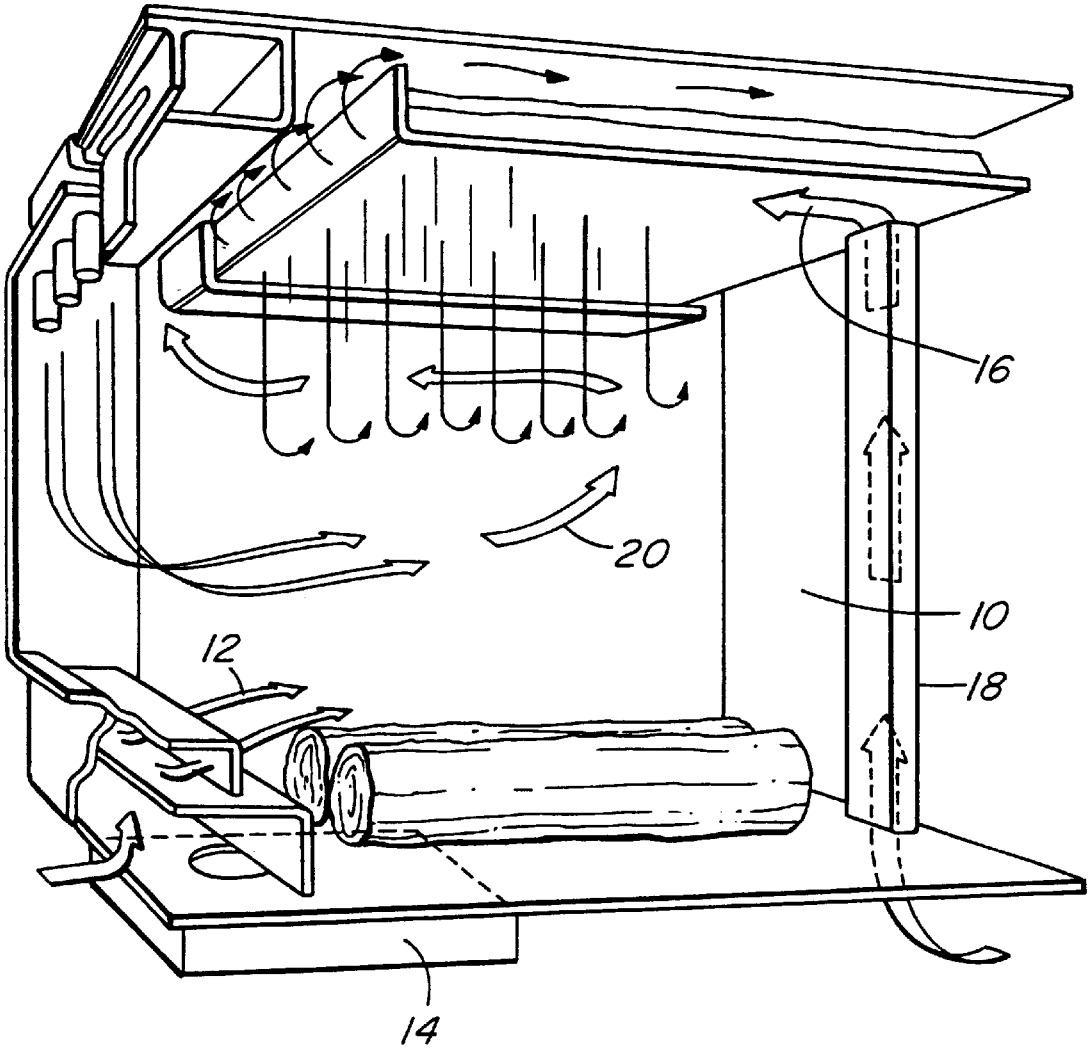
FIG. 1 is a schematic view showing the combustion chamber of a wood stove with a bi-metal closure valve according to one embodiment of the present invention.

A combustion chamber 10 of a wood stove is shown in FIG. 1 with three different air systems, a primary air supply 12 which enters at the lower front of the combustion chamber through the bi-metal valve 14 of the present invention. A secondary air supply 16 shown at the top front of the wood stove entering through duct 18. The third air system is an air wash 20 entering from the top front of the combustion chamber 10.

Figure 2:
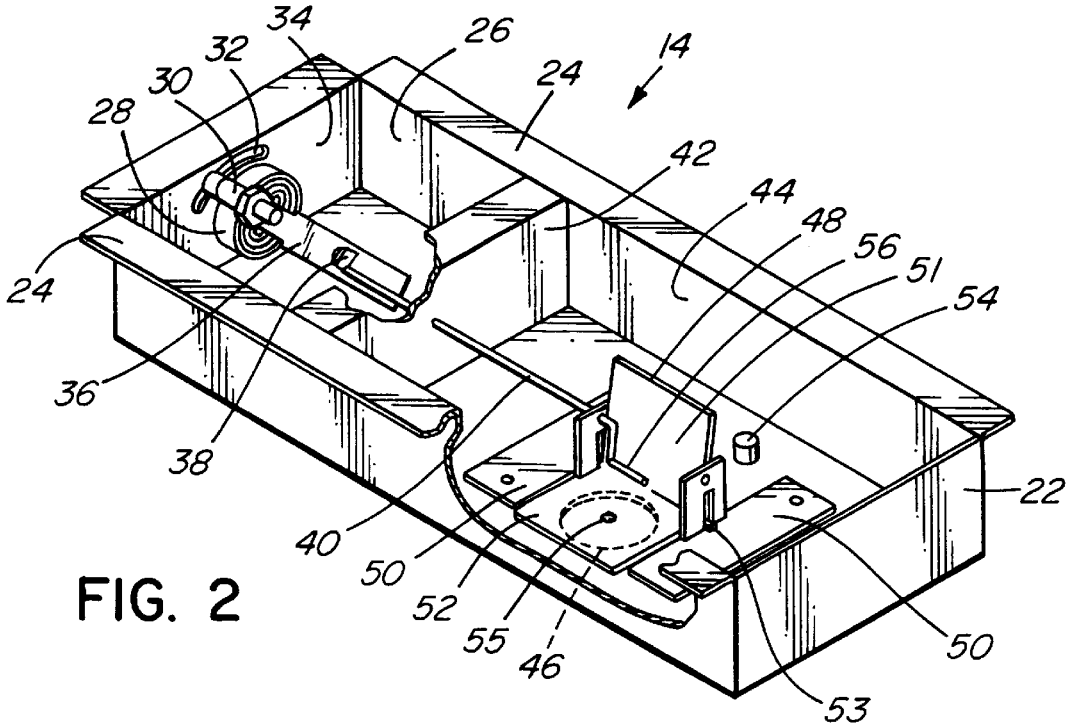
FIG. 2 is an isometric view showing one embodiment of a bi-metal closure valve according to the present invention with the valve closed.
Figure 3:
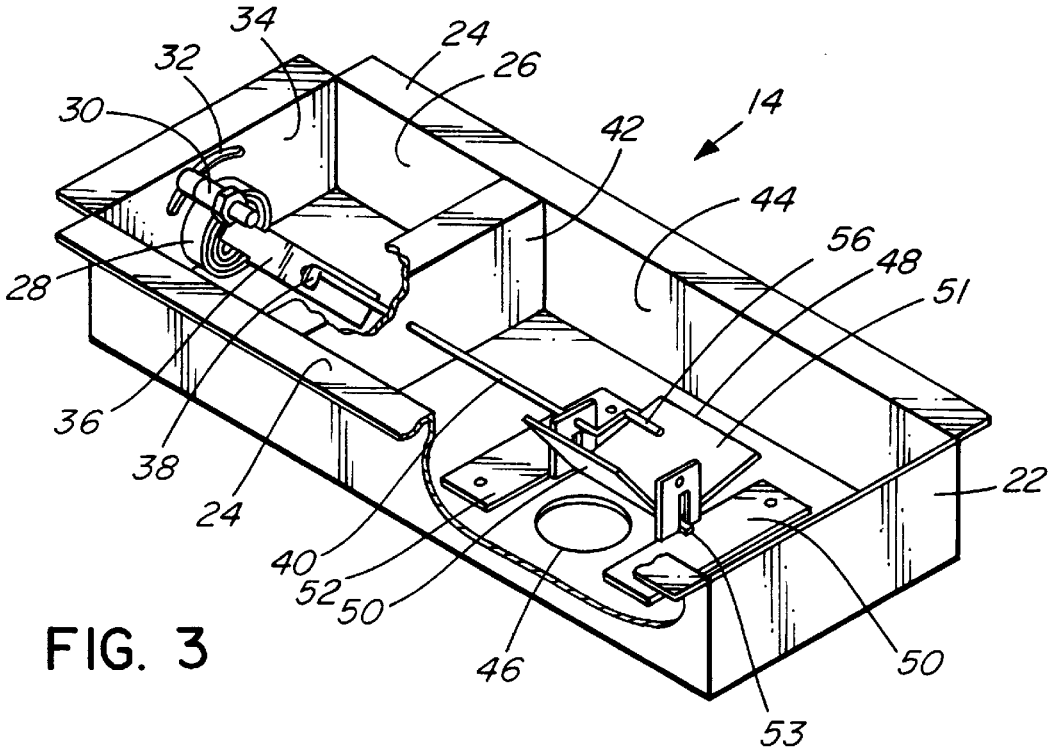
FIG. 3 is an isometric view of the bi-metal closure valve as shown in FIG. 2 with the valve open.

The bi-metal closure valve 14 is shown in more detail in FIGS. 2 and 3 and has a casing 22 with attachment flanges 24 for mounting on the underside of the stove. The casing is divided into two compartments, a first compartment 26 which contains a bi-metal strip coil 28 with the outer end of the coil 28 attached by means of a screw 30 to a curved slot 32 in the end wall 34 of the casing 22. A flat strip 36 is connected to the inner end of the bi-metal coil 28 and has an attachment screw 38 connecting to a crank arm 40 which passes through a divider wall 42 into a second chamber 44. In the second chamber 44 there is a round air inlet 46 in the base which has a flap 48 pivoted on two brackets 50. The flap 48 is substantially L-shaped with a first portion 51 and a second portion 52 extending from a pivot position 53 and has a stop 54 as shown more clearly in FIG. 2 that prevents the flap 48 from opening beyond a preset amount. The flap 48 is kept closed by gravity and even when in the full open position and having the first portion 51 of the flap 48 touching the stop 54, it is still biased to close. The second portion 52 of the flap 48 rests over the air inlet 46 and has a small aperture 55 therein for an air bleed for the stove. The crank arm 40 extends through one of the brackets 50 and has a crank 56 which when rotated pushes against the first portion 51 to open the flap 48. The flap 48 is biased to be closed at all times and is only opened when the crank 56 pushes against the first portion 51 of the flap 48.

In operation, when the valve is closed as shown in FIG. 2, by setting the position of the outer end of the bi-metal coil 28 by the adjustment screw 30 in slot 32, the crank arm 40 is allowed to rotate as the temperature increases until when a preset temperature is reached the crank 56 at the end of the crank arm 40 contacts the first portion 51 of the flap 48 and pushes against this to pivot the flap 40 open until it rests on stop 54. The position of the stop 54 can be adjusted to control the amount of opening for the air inlet 46. The flap 48 remains open when it is contacted by the crank 56. When the bi-metal coil 28 commences to cool, then the crank arm 40 rotates so the crank 56 permits the flap 48 to close by gravity. When it is completely closed, the crank arm 40 can continue to rotate with the crank 56 being quite independent of the flap 48 which is now closed. When heating commences again there can be considerable temperature rise before the crank 56 contacts the first portion 51 of the flap 48.

Variations in the system can be made. The size of the crank 56 can be varied. The position of the bi-metal coil 28 can be varied so that the temperature can be selected where the crank 56 contacts the first position 51 of flap 48. Furthermore, the stop 54 behind the flap 48 can be adjusted to control the angle to which the flap 48 can be opened. Because the flap 48 moves quite independently of the crank arm 40 connected to the bi-metal coil 28, there is no stress upon the bi-metal coil and this extends the life of the bi-metal coil 28.

Various changes may be made to the embodiments disclosed herein without departing from the scope of the present invention which is limited only by the following claims.

I claim:

1. A method of controlling air flow through an air inlet to a combustion chamber of a wood burning stove comprising the steps of:

sensing temperature rise in the combustion chamber of the wood stove with a bi-metal strip coil having a fixed outer end and a crank arm connected to a floating inner end;

rotating the crank arm as the temperature rises to push against a free pivoted flap retained by gravity over the air inlet to open the air inlet and permit air to flow therethrough to increase combustion in the combustion chamber;

sensing temperature drop in the combustion chamber of the wood stove with the bi-metal coil;

rotating the crank arm in the opposite direction from the temperature rising, as the temperature drops to permit the flap to close by gravity over the air inlet to reduce combustion in the combustion chamber; and permitting the crank arm to continue rotating as the temperature drops without effecting the closed flap.

2. The method of controlling air flow according to claim 1 including the step of adjusting position of the fixed outer end of the bi-metal strip coil to set the temperature that the crank arm pushes against the pivoted flap to open the air inlet.

3. The method of controlling air flow according to claim 1 including providing an opening stop for the pivoted flap to set a predetermined open position for the flap.

4. The method of controlling air flow according to claim 1 wherein the air inlet is positioned at a front base of the wood stove.

5. The method of controlling air flow according to claim 4 wherein the bi-metal strip coil is located in a location that does not produce erratic fluctuations in temperature.

6. The method of controlling air flow according to claim 5 wherein the bi-metal coil is placed beneath the wood stove attached to the front base thereof.

7. The method of controlling air flow according to claim 1 wherein the air inlet represents a primary air supply inlet with at least one other air inlet provided in the wood stove separate from the primary air supply inlet.

8. A bi-metal closure valve for an air supply inlet for the combustion chamber of a wood stove, comprising:

a casing mountable to the wood stove to enclose the closure valve;

a free pivoted L-shaped flap, the flap having a first portion and a second portion extending from a pivot position and supported by the casing, the first portion positioned over the air supply inlet and retained over the inlet by gravity;

a crank arm supported by the casing to rotate and push against the second portion of the flap to open the flap a predetermined amount; and a bi-metal strip coil having an outer end attached to the casing and a floating inner end attached to the crank arm, the strip coil being positioned to detect the temperature of the combustion chamber of the wood stove such that a change in combustion chamber temperature causes the crank to rotate to open the flap or allow the flap to close by gravity to vary combustion in the wood stove.

9. The bi-metal closure valve according to claim 8 wherein the predetermined amount of opening for the flap is variable to vary air flow through the air inlet.

10. The bi-metal closure valve according to claim 8 wherein the bi-metal coil rotates the crank arm when the temperature rises to push against the second portion of the flap to open the air inlet.

11. The bi-metal closure valve according to claim 10 wherein the outer end of the bi-metal coil is mounted to the casing via an adjustment screw in a slot such that slidable movement of the screw in the slot changes the temperature setting to open the flap.

12. The bi-metal closure valve according to claim 8 wherein the crank arm of the bi-metal coil rotates permitting the flap to close by gravity when the temperature drops, the crank arm permitted to rotate without effecting the flap after the flap has closed.

13. The bi-metal closure valve according to claim 8 including a divider between the bi-metal coil and the flap so air passing through the air inlet does not contact the bi-metal coil.

14. The bi-metal closure valve according to claim 8 wherein the closure valve is positioned at a front base of the wood stove.

15. The bi-metal closure valve according to claim 14 wherein the closure valve is located over a primary air supply inlet to the wood stove.

16. The bi-metal closure valve according to claim 8 including a small aperture in the first portion of the flap to permit a small quantity of air to pass therethrough when the flap is over the air supply inlet.

17. The bi-metal closure valve according to claim 8 in which the first and second portions of the L-shaped flap intersect at a common edge that defines the axis of pivoting of the flap with the crank arm extending into the region between the first and second portions parallel to the axis of pivoting.

* * * * *